United States Patent [19]

Smith

[11] 4,448,462

[45] May 15, 1984

[54] TOWEL DISPENSER

[75] Inventor: Randel P. Smith, Chicago, Ill.

[73] Assignee: Steiner Corporation, Salt Lake City, Utah

[21] Appl. No.: 179,652

[22] Filed: Aug. 20, 1980

[51] Int. Cl.[3] ..... B65H 19/00

[52] U.S. Cl. ..... 312/38; 312/37; 242/55.2

[58] Field of Search ..... 312/37, 38; 242/55.2, 242/55.53

[56] References Cited

U.S. PATENT DOCUMENTS

| | | | |
|---|---|---|---|
| 1,853,705 | 4/1932 | Steiner | 312/38 |
| 1,893,343 | 1/1933 | Tyler | 312/38 |
| 2,295,252 | 9/1942 | Birr et al. | 312/38 |
| 2,425,915 | 8/1947 | Birr | 312/38 |
| 2,772,133 | 11/1956 | Birr | 312/38 |
| 2,899,251 | 8/1959 | Birr | 312/38 |
| 3,637,275 | 1/1972 | Bahnsen | 312/38 |
| 3,684,338 | 8/1972 | Bahnsen | 312/38 |
| 3,728,001 | 4/1973 | Bahnsen | 312/38 |
| 3,858,953 | 1/1975 | Bahnsen | 312/38 |
| 3,870,212 | 3/1975 | Polk | 242/55.2 |

FOREIGN PATENT DOCUMENTS

| | | | |
|---|---|---|---|
| 673964 | 11/1963 | Canada | 312/37 |

*Primary Examiner*—Victor N. Sakran

*Attorney, Agent, or Firm*—Ditmar, Stotland, Stratman & Levy

[57] ABSTRACT

A towel dispenser of the continuous loop type wherein the housing has two spaced apart and vertically extending support members mounted on the rear wall, each support member having a cantilever portion with mounting mechanism for pivotally mounting a towel bed thereon, towel dispensing mechanism mounted in the housing for dispensing clean towel therefrom into the loop along an exit path when the accessible portion of the loop is pulled by the user, loop take-up mechanism mounted in the housing coupled to the towel dispensing mechanism for retracting and storing soiled towel from the return path. The loop take-up mechanism includes a take-up roll for storing soiled towel and drive mechanism coupled to the dispensing mechanism for driving the take-up roll. Also disclosed is mechanism for controlling slippage between the take-up roll and the drive mechanism therefor including towel breaker means for adjusting the tension in the soiled towel to vary the amount of soiled towel taken up during operation of said loop take-up mechanism to control the amount of towel in the loop.

24 Claims, 8 Drawing Figures

FIG. 4
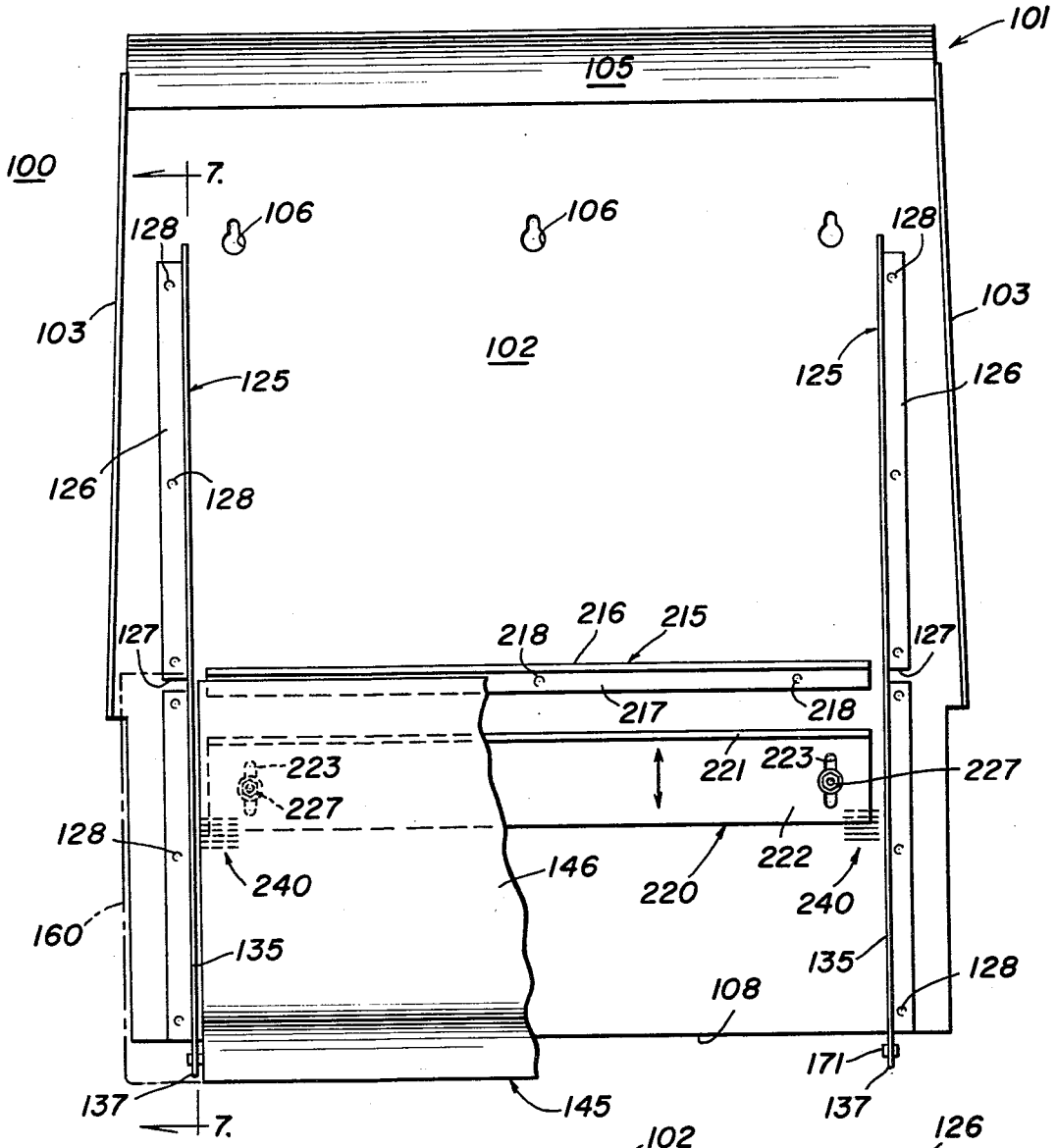
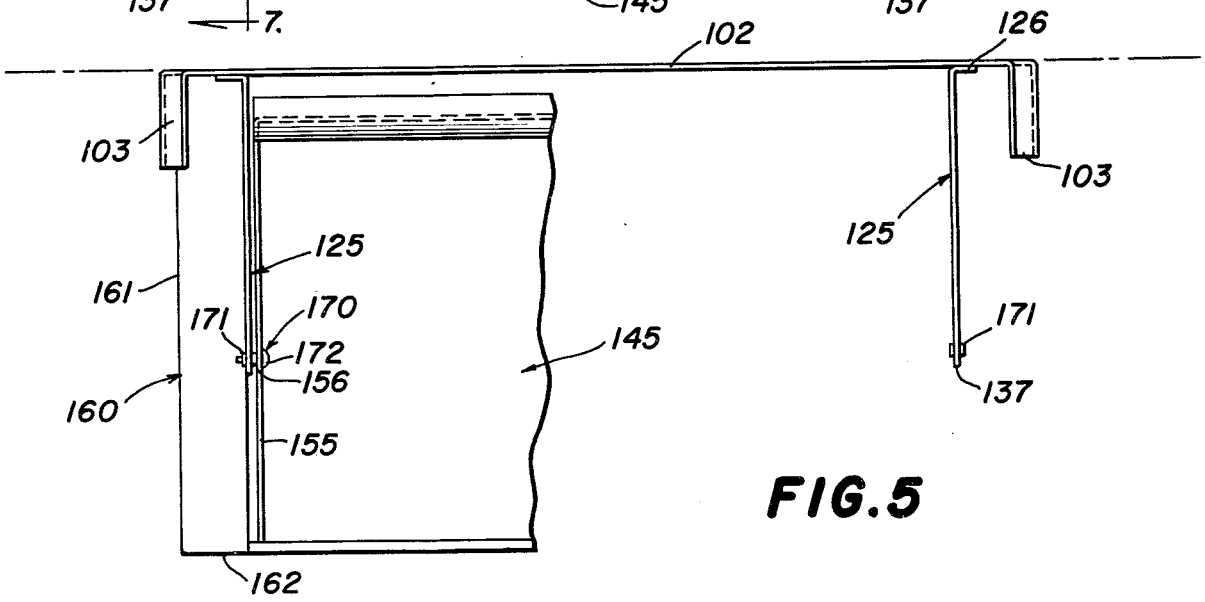
FIG. 5

TOWEL DISPENSER

BACKGROUND OF THE INVENTION

The present invention relates generally to improvements in towel dispensing cabinets, and specifically to improvements in the operation of cloth towel dispensing cabinets of the continuous type incorporating mechanism for controlling the amount of towel in the loop of towel and for support mechanism having a cantilevered portion on which is mounted the clean towel bed and which accommodates the mounting of end pieces thereon.

Clean towel dispensing cabinets of the continuous type incorporating towel breakers for smoothing the soiled towel during the take-up thereof prior to storage on the take-up roll mechanism is well known in the prior art. Difficulty has been experienced in trying to maintain a constant amount of towel forming the loop. During operation of towel dispenser cabinets of the continuous loop type, the loop of towel often becomes longer or shorter during successive operations and it is relatively difficult to maintain a constant loop size.

Traditionally, towel dispensers of the continuous loop type have had mounting brackets attached to the back plate thereof for accommodating the clean towel storage bed, but this construction is inadequate to support separate end pieces which may be decorative in nature, such as transparent plastic end pieces having various color tints.

Pertinent examples of prior towel dispensing cabinets of the continuous loop type on which the improvement of the present invention is useful are those illustrated in U.S. Pat. No. 2,899,251 issued Aug. 11, 1959 to R.G. Birr for Towel Dispensing Cabinets; U.S. Pat. No. 3,728,001 issued Apr. 17, 1973 to Bahnsen for Towel Dispensing Cabinet with Scraper Attachment; and U.S. Pat. No. 3,684,338 issued Aug. 15, 1972 to Bahnsen for Compact Towel Dispenser.

SUMMARY OF THE INVENTION

The present invention provides a dispensing cabinet for continuous cloth toweling which permits the amount of towel in the loop to be controlled.

The present invention also provides a dispensing cabinet for continuous cloth toweling which permits pivotal mounting of the clean towel bed thereon and accommodates the mounting of separate end caps.

This is accomplished in the present invention, and it is an object of the present invention to accomplish these desired results by providing a towel dispenser of the continuous loop type comprising a housing having associated therewith a loop of towel that extends along an exit path from a clean towel supply within the housing to an exposed position accessible to a user and thence along a return path into the housing, towel dispensing mechanism mounted in the housing for dispensing clean towel therefrom into the loop along the exit path when the accessible portion of the loop is pulled by the user, loop take-up mechanism mounted in the housing coupled to the towel dispensing mechanism for retracting and storing soiled towel from the return path, the loop take-up mechanism including a take-up roll for storing soiled towel and drive mechanism coupled to the dispensing mechanism for driving the take-up roll, and mechanism for controlling slippage between the take-up roll and the drive mechanism therefor, reducing slippage between said take-up roll and the drive mechanism therefor causing a greater quantity of soiled towel to be stored per revolution of the take-up roll, increasing slippage between the take-up roll and the drive mechanism therefor causing a lesser quantity of soiled towel to be stored per revolution of the take-up roll, thereby to control the amount of towel in the loop.

In connection with the foregoing object, it is another object of the invention to provide a towel dispenser of the type set forth wherein there is provided tension control mechanism for adjusting the tension in the soiled towel retracted and stored by the loop take-up mechanism to vary the amount of soiled towel taken up during operation of the loop take-up mechanism to control the amount of towel in the loop.

Yet another object of the present invention is to provide a towel dispenser of the type set forth including means defining a sinuous return path for the soiled towel including a plurality of edge members disposed in engagement with the soiled towel along the return path, and means providing relative movement between at least two of the edge members to adjust the tension in the soiled towel retracted and stored by the loop take-up mechanism to vary the amount of soiled towel taken up during operation of the loop take-up mechanism to control the amount of towel in the loop.

Yet another object of the present invention is to provide a towel dispenser of the type set forth wherein towel breaker mechanism is mounted in the housing and has first and second edge members disposed in engagement with the soiled towel along the return path thereof, a towel bed mounted in the housing for accommodating a supply of clean towel therein and having a third edge member thereon, the third edge member being disposed in engagement with the soiled towel along the return path thereof and cooperating with the first and second edge members for smoothing and tensioning the soiled towel, and means for adjusting the tension in the soiled towel to vary the amount of soiled towel taken up during operation of the loop take-up mechanism to control the amount of towel in the loop.

Still another object of the present invention is to provide a towel dispenser of the continuous loop type having slippage and tension control mechanism wherein said housing includes a rear wall adapted to be mounted on a support surface and a cover having a front with the bottom edge thereof above the bottom edge of said rear wall and two sides removably mounted on the rear wall, two spaced apart and vertically extending support members mounted on the rear wall, each support member having a cantilever portion with mounting mechanism, a towel bed mounted to the mounting mechanism on the cantilever portions of the support members moveable between a dispensing configuration wherein the towel bed is in the closed position thereof and a loading configuration wherein the towel bed extends outwardly from the housing to facilitate the loading of clean towel thereinto, two end pieces each removably mounted on a respective one of the support members to cover the ends of the towel bed.

Still another object of the present invention is to provide a towel dispenser of the continuous loop type comprising a housing having associated therewith a loop of towel that extends along an exit path from a clean towel supply within the housing to an exposed position accessible to a user and thence along a return path into the housing, the housing including a rear wall adapted to be mounted on a support surface and a cover having a front with the bottom edge thereof above the bottom edge of the rear wall and two sides removably mounted on the rear wall, two spaced apart and vertically extending support members mounted on the rear wall, each support member having a cantilever portion with mounting mechanism, a towel bed mounted to the mounting mechanism on the cantilever portions of the support members moveable between a dispensing configuration wherein the towel bed is in the closed position thereof and a loading configuration wherein the towel bed extends outwardly from the housing to facilitate the loading of clean towel thereinto, and two end pieces each removably mounted on a respective one of the support members to cover the ends of the towel bed.

Further features of the invention pertain to the particular arrangement of the parts of the towel dispenser whereby the above-outlined and additional operating features thereof are attained.

The invention, both as to its organization and method of operation, together with further features and advantages thereof will be best understood with reference to the following specification taken in conjunction with the accompanying drawings.

BRIEF DESCRIPTION OF THE DRAWINGS

FIG. 4 is a front elevational view of the towel dispenser illustrated in FIG. 1 with the front cover removed, particularly illustrating the relationship of the back wall and support members as well as the slippage and tension control mechanism;

FIG. 5 is a top plan view of the towel dispenser illustrated in FIG. 4 with certain portions of the towel bed broken away;

DETAILED DESCRIPTION OF THE PREFERRED EMBODIMENTS

Figure 1:
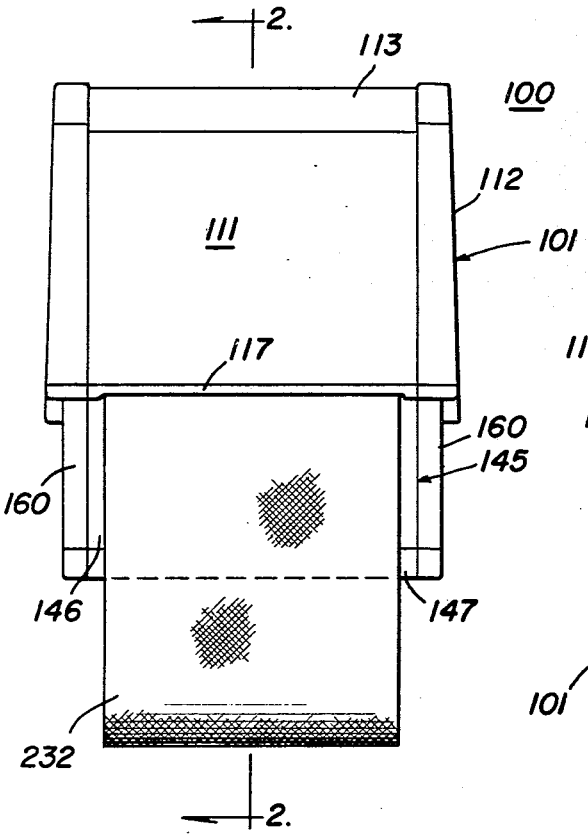
FIG. 1 is a front elevational view of a towel dispenser constructed in accordance with and embodying the features of the present invention.
Figure 2:
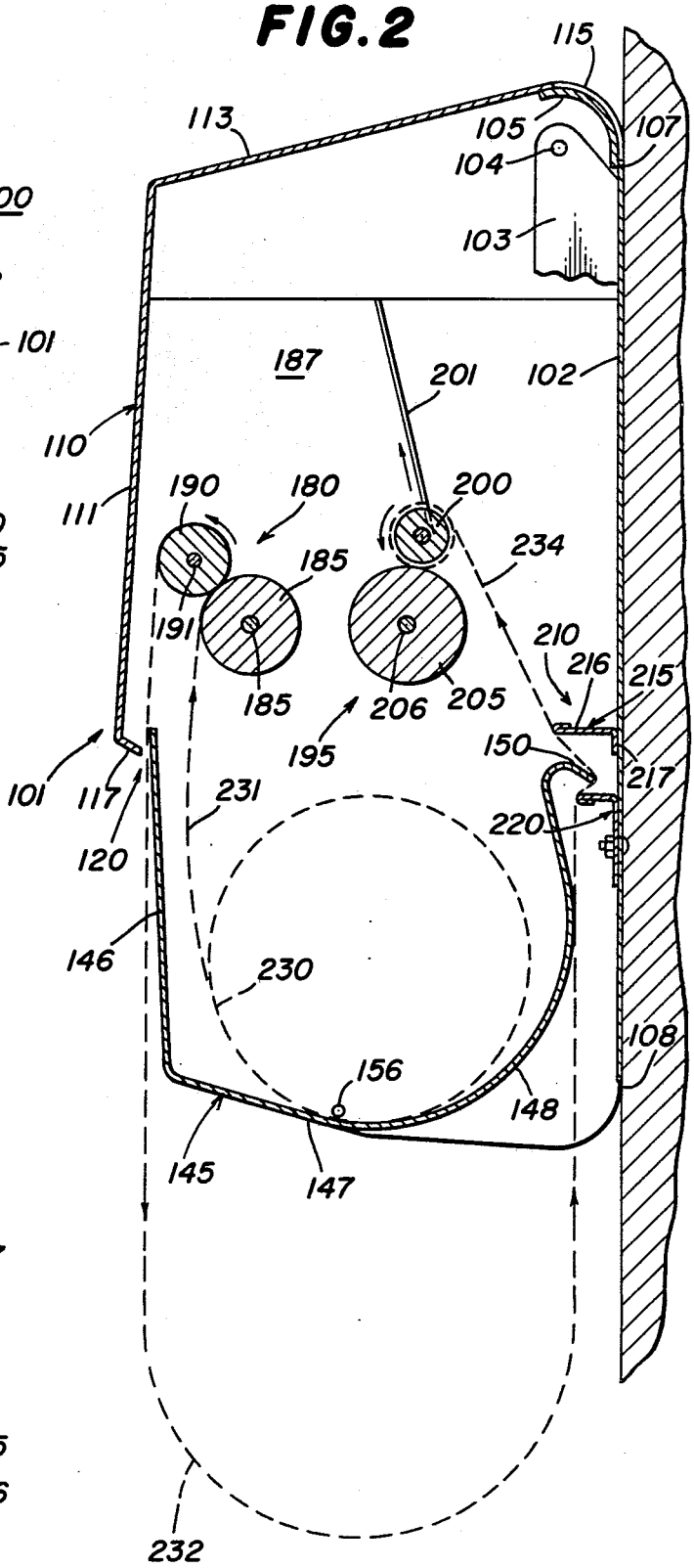
FIG. 2 is a diagrammatic view in vertical section of the towel dispenser illustrated in FIG. 1 as viewed along the line 2—2 thereof.

Referring now to the drawings, there is disclosed a towel dispenser 100 having a supply of clean towel 230 in a towel bed 145 with a web 231 of towel passing through a towel dispensing mechanism 180 to form a loop 232 exterior to the dispenser and thence through a slippage and tension control mechanism 210 to a loop take-up mechanism 195, the dispenser including an enclosed housing 101 having a rear wall 102 adapted to be mounted on a support surface such as a wall. The rear wall 102 of the housing 101 has wrap around flanges 103 each of which is provided near the upper end thereof with an aperture 104, for a purpose to be explained, the rear wall 102 having bottom edge 108. An arcuate support piece 105 is integral with the rear wall 102 and extends upwardly above the top of the wrap around flanges 103 and forms an insert 107 with the main portion of the rear wall. As best seen in FIG. 4, there are a plurality of key hole slots 106 for mounting the rear wall 102 to the adjacent support or wall.

A cover 110 cooperates with the rear wall 102 to form the enclosed housing 101, the cover 110 having a front 111 integral with a pair of sides 112 and having a top 113, the top 113 being hinged to an arcuate top portion 115 having the same radius of curvature as the arcuate support 105 of the rear wall 102 which acts as a support therefor. The portion 115 of the cover 110 fits over the portion 105 of the rear wall 102 and fits into the inset 107, the top 113 having an over center spring device (not shown) which is mounted to the flanges 103 and particularly in the apertures 104 thereof. The front 111 of the cover 110 has the bottom edge thereof formed into an inwardly turned flange 117 which cooperates with the towel bed 145, as will be explained, to provide an access opening 120 through which the towel web 231 exits from the dispenser 100.

Two spaced apart vertically extending support members 125 are mounted on the rear wall 102 near the associated flange 103. Each of the support members has an attachment portion 126 extending from close to the top of the rear wall 102 to substantially coterminous with the bottom edge thereof. The attachment portion 126 of each support member 125 has an interruption 127 in the lower part of the attachment member 126, the attachment portion 126 being connected to the rear wall 102 by suitably placed spot welds 128. Each of the support members 125 has a body portion 130 integral with the attachment portion 126 and extending generally perpendicularly thereto, the body portion 130 being provided with two vertically aligned and spaced apart mounting apertures 131 and 132. Each body portion 130 further includes a cantilever portion 135 defined by an arcuate edge 136, the cantilever portion 135 terminating at a free end 137 having an aperture 138 therein. It is to be understood that there are two support members 125 which are mirror images of each other, one being provided on the righthand side of the towel dispenser 100 and the other being provided on the left-hand side, as illustrated in FIG. 4.

Figure 8:
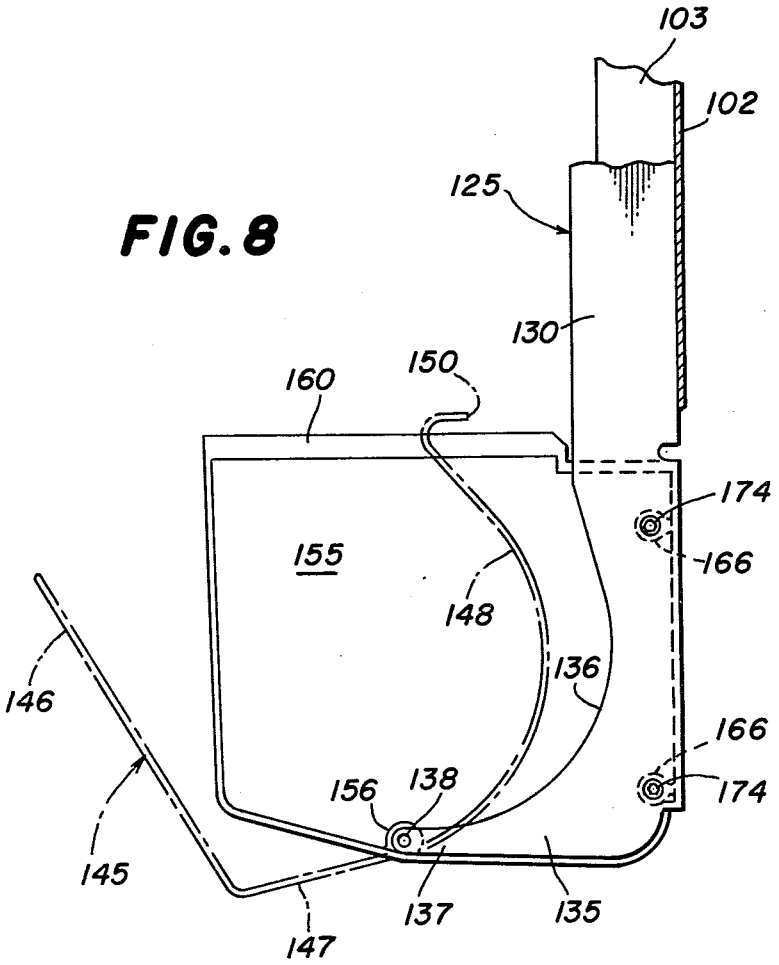
FIG. 8 is a view like FIG. 7 illustrating the relationship between the support mechanism, the towel bed and the end cap.

Pivotally mounted to the cantilever portions 135 of the support members 125 is a towel bed 145 for holding the supply 230 of clean towel, as will be explained. The towel bed 145 is generally cylindrical in shape and has a front portion 146 which is straight and integrally connected to a downwardly sloping bottom portion 147 having a rearwardly and upwardly curved portion 148 terminating in a towel smoother flange 150 being provided as a reverse curve portion having a towel smoothing surface 151. The towel bed 145 extends substantially the entire distance between the body portions 130 of the support members 125 and is closed by sides 155, see FIG. 8, each of which is provided at the juncture of the respective side and bottom 147 with a mounting tab 156 having an aperture 157 therein for pivotally mounting the towel bed 145 to the support members, as will be explained.

Figure 6:
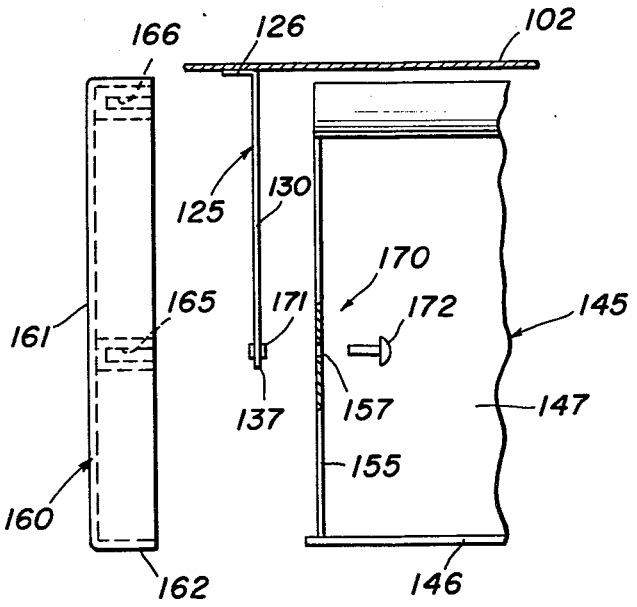
FIG. 6 is an exploded view of the left-hand portion of the towel dispenser illustrated in FIG. 5.
Figure 7:
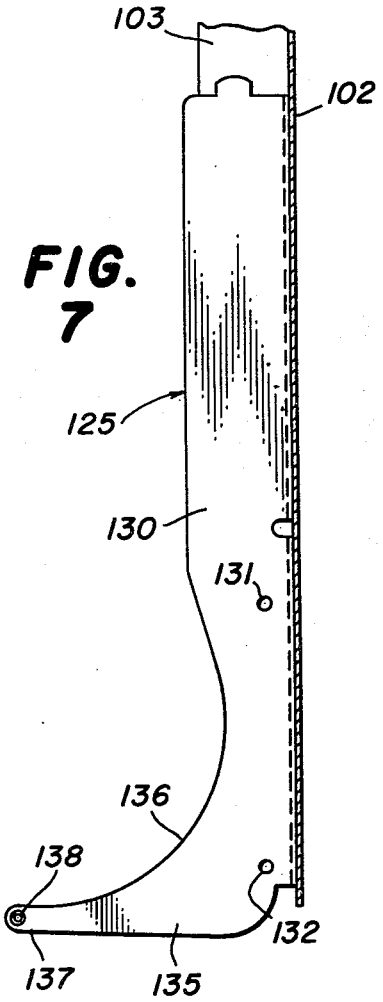
FIG. 7 is a view in vertical section of the towel dispenser illustrated in FIG. 4 as viewed along the line 7—7 thereof particularly illustrating a support mechanism with the cantilever portion thereof.

Two end caps 160 serve to close the housing 101 and fit between the bottommost portions of the side flanges 103, each of which is tapered outwardly, and the bottommost portion 147 of the towel bed 145, thereby to provide a clean and sleek towel dispenser 100. The end caps 160 because they are independent pieces, may be decorative in nature and constructed out of a transparent synthetic organic resin which may be tinted. Specifically, each end cap 160 is provided with, as best seen in FIGS. 5 and 6, an end panel 161 and an integral wrap around flange 162. Each of the end caps 160 is further provided with a central core 165 and two vertically aligned end cores 166.

The towel bed mounting means 170 includes, as particularly seen in FIG. 6, a bushing 171 for each of the two support members 125 and particularly for each of the apertures 138 and the free ends 137 thereof, and two truss head screws 172, one for each support member 125, the truss head screws pivotally mounting the towel bed 145 to the appropriate support member 125 and to the central core 165 in the associated end cap 160. Each end cap 160 is further mounted to the housing 101 by means of two self-tapping, hex head screws 174 which extend through the mounting apertures 131 and 132 in each of the support members 125 and into the appropriate cores 166 of the associated end cap 160, thereby to mount the end caps 160 to the housing 101 by an internal connection so as to prevent removal of the end caps 160 by a user of the towel dispenser 100.

The towel dispenser 100 includes, as is well known in the art, towel dispensing mechanism 180 having a measuring roll 185 mounted for rotation about a shaft 186 journalled in side plates 187 which are suitably but removably mounted to the rear wall 102. The measuring roll 185 is driven by co-action with a pinch roll 190 having a shaft 191 also suitably journalled in the side plates 187. Also as is well known in the art, there is provided a loop take-up mechanism 195 which includes a take-up roll 200 constructed and arranged to travel along the upwardly and forwardly inclined guides 201, one being provided on the side plates 187, so as to accommodate the ever increasing diameter of soiled towel rolled and accumulated on the take-up roll 200. The take-up roll 200 is driven by a take-up drive roll 205 having a shaft 206 journalled for rotation in the side plates 187, the take-up drive roll 205 being drivingly connected to the measuring roll 185 by mechanism not shown, all as described in the previously mentioned Birr U.S. Pat. No. 2,899,251 the disclosure of which is incorporated herein by reference.

There is further provided a slippage and tension control mechanism 210 for adjusting the amount of towel in the exterior loop 232 as will be explained, which includes a towel breaker 215 as particularly illustrated in FIGS. 3 and 4, having an engagement or edge member portion 216 extending generally perpendicularly to the back wall 102 and an attachment portion 217, a plurality of spot welds 218 connecting the breaker 215 to the back wall 102. The slippage and tension control mechanism 210 further includes an adjustable towel breaker 220 having an engagement or edge member portion 221 extending generally perpendicular to the back wall 102 and an attachment portion 222 provided with a plurality of vertically extending slots therein, the attachment portion 222 of the breaker 220 being substantially greater in vertical extent than the attachment portion 217 of the breaker 215 in order to accommodate the slots 223 in the attachment portion thereof. The adjustable breaker 220 is mounted on the rear wall 102 by means of two or more bolts 225 extending through suitable openings in the back wall 102 having the heads thereof welded as at 226 to the outer surface of the back wall 102. Nuts 227 fixedly position the adjustable towel breaker 220 at the predetermined desired vertical distance from the fixed towel breaker 215. The slippage and tension control mechanism 210 is completed by the presence of the towel smoother flange 150 on the rear end of the towel bed 145, the towel smoothing surface 151 of the smoother flange being positioned intermediate the first and second towel breakers 215 and 220 and being closer to the back wall 102 than either of the engagement or edge portions 216 and 221, whereby to provide a sinuous path for the soiled towel passing through the slippage and tension control mechanism 210 before being retracted and stored on the take-up roll 200 by operation of the loop take-up mechanism 195.

The towel dispenser 100 has the clean towel supply 230 positioned in the towel bed 145, the clean towel supply 230 having the towel web 231 passing upwardly from the towel bed 145 against the measuring roll 185 upwardly and around the pinch roll 190 and then downwardly through the access opening 120 to form the loop 232 of towel exterior to the housing 101 and accessible to a user. The towel loop 232 returns along a soiled towel flight 234 and passes through the slippage and tension control mechanism 210 to the loop take-up mechanism 195 to be wrapped around the take-up roll 200. As is well known in the art, continued withdrawal of clean towel from the clean towel supply 230 coupled with continual operation of the loop take-up mechanism 195 results in soiled towel being accumulated on the take-up roll 200 which continually increases in diameter and travels upwardly and forwardly along the guides 201.

Finally there is provided indicator means 240 for replicating a predetermined position of the movable or adjustable towel breaker 220 with respect to the fixed towel breaker 215, the indicator means 240 being comprised of a plurality of vertically aligned horizontally spaced apart and graduated indicia or scales positioned at the respective ends of the adjustable towel breaker 220, thereby to permit the attendant to place the slippage and tensioning control mechanism 210 in a predetermined position.

Operation of the towel dispenser 100 will be explained. The towel bed 145 is opened to the phantom line position of FIG. 8 to accept a supply of clean towel 230 therein. The attendant threads the web 231 of towel upwardly and against the measuring roll 185 and then around the pinch roll 190 and thence downwardly through the access opening 120 provided by the cooperation of the inturned flange 117 of the front 111 and the front portion 146 of the towel bed 145. An appropriate loop 232 of towel exterior to the housing 101 is formed and a return flight 234 of the towel is passed through the slippage and tension control mechanism 210 and is suitably connected to or wrapped around the take-up roll 200 of the loop take-up mechanism 195. After the housing 101 is closed, the towel dispenser 100 is ready to operate. A user pulls a portion of the loop 232 downwardly, thereby forcing the pinch roll 190 into driving relationship with the measuring roll 185. The measuring roll 185 turns a predetermined number of revolutions or portions thereof and is stopped by mechanism, not shown.

Rotation of the measuring roll 185 simultaneously causes the loop take-up mechanism 195 to operate and particularly causes the take-up drive roll 205 to rotate in a clockwise direction, thereby causing the take-up roll 200 to rotate in a counterclockwise direction and to accumulate or store soiled towel thereon. Because the loop take-up mechanism 195 is a friction drive device, that is the take-up roll 200 is driven by frictional engagement between the drive roll 205 which may be provided with an abrasive surface thereon and the outer layer of the soiled towel wrapped around the take-up roll 200, slippage may occur between the take-up roll 200 and the drive roll 205 therefor which causes the loop 232 to vary in length. If the tension in the return flight 234 of the soiled towel increases, then a greater torque is required of the drive roll 205 to drive the take-up roll 200 and slippage may occur. If slippage increases due to the increased tension in the flight 234, then less soiled towel will be accumulated on the take-up roll 200 per unit operation of the dispensing mechanism 180, thereby causing the loop 232 to increase in length. If the tension in the soiled towel flight 234 is decreased, then less torque is required to drive the drive roll 205 and a greater amount of soiled towel is stored on the take-up roll 200 per unit operation since the slippage between the drive roll 205 and the take-up roll 200 is diminished.

The slippage between the frictionally driven take-up roll 200 and the drive roll 205 therefor is controlled in the present towel dispenser 100 by adjusting the tension in the flight 234 of the soiled towel which is fed to the loop take-up mechanism 195. Tension control, and hence slippage control is achieved by the mechanism 210 which may be adjusted so as to cause greater or lesser tension in the soiled towel flight 234.

Figure 3:
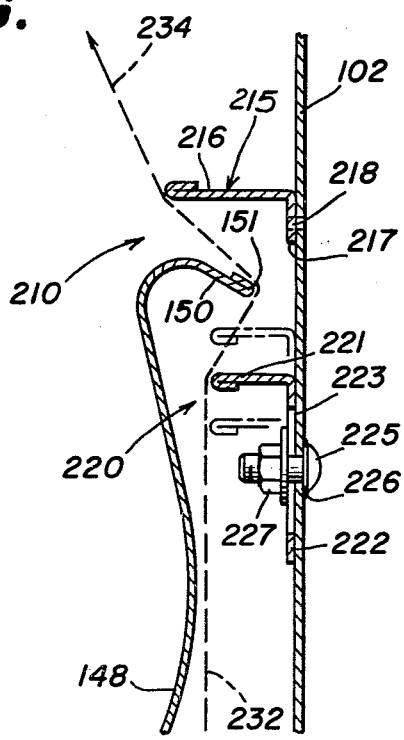
FIG. 3 is an enlarged view of the slippage and tension control mechanism of the present invention used to control the amount of towel in the loop illustrated in various positions thereof.

Referring to FIG. 3, there is shown several positions of the infinitely adjustable towel breaker 220 causing the tension in the flight 234 to vary. The tension in the flight 234 can be increased by moving the adjustable towel breaker 220 and particularly the engagement portion 221 thereof to the uppermost position illustrated in phantom. The tension in the soiled towel on the way to the loop take-up mechanism 195 is increased by the change in the angle of the sinuous path through which it must pass by movement of the engagement portion 221 of the adjustable towel breaker 220 to the uppermost position. This increases the drag or resistance of the towel through the mechanism 210 and thereby increases the tension in the soiled towel flight 234 resulting in a greater torque required to rotate the take-up roll 200, thereby increasing slippage between the take-up roll 200 and the drive roll 205 therefor. This results in less soiled towel being stored on the take-up roll 200 per unit operation of the dispensing mechanism 180 thereby resulting in an increased quantity of towel in the loop 232.

By adjusting the towel breaker 220 so that the engagement portion 221 thereof is in the lowermost position illustrated in phantom in FIG. 3, the angular relationship between the smoothing edge 150 and the engagement portion 221 is changed so as to diminish the drag or resistance of the soiled towel transmitted to the loop take-up mechanism 195 and hence decrease the tension in the towel flight 234. By decreasing the tension in the towel flight 234, there is less torque required to drive the take-up roll 200 thereby decreasing the slippage between the take-up roll and the drive roll 205 therefor resulting in a greater quantity of soiled towel being stored on the take-up roll 200 per unit operation of the dispensing mechanism 180.

As may be seen, the greater the tension in the towel flight 234, the more the slippage between the take-up roll 200 and the drive roll 205 therefor and the tighter the soiled towel will be wound around the take-up roll 200, all contributing to storing less soiled towel on the take-up roll 200 per unit operation of the dispensing mechanism 180 resulting in a greater amount of towel in the loop 232. Conversely, decreasing the tension in the towel flight 234 results in a lower torque necessary to drive the take-up roll 200 permitting more soiled towel to be stored on a take-up roll per unit operation of the dispensing mechanism 120 and also results in a looser winding of the soiled towel on the take-up roll 200, all contributing to taking up more soiled towel per unit operation of the dispensing mechanism 180 resulting in a lesser amount of towel in the loop 232.

As may be seen, there has been provided mechanism for controlling the amount of towel in the loop 232 which permits the attendant by means of the indicator mechanism 240 to preset the size of the loop 232, resulting in better control than heretofore possible. There also has been provided support members for pivotally mounting the towel bed thereto and for mounting the end caps thereon, the end caps being discrete members to provide decorative possibilities to the towel dispenser 100 as well as providing a clean and sleek outline.

More particularly, there has been provided slippage and tensioning control mechanism 210 defining a sinuous path for the return flight of the soiled towel wherein fixed and movable towel breakers 215 and 220 are utilized to adjust slippage and tension, thereby to control the amount of towel in the loop 232.

Although a preferred embodiment of the present invention has been shown and described for illustrative purposes, it will be appreciated that various changes and modifications can be made therein without departing from the spirit and scope of the invention.

What is claimed is:

1. A towel dispenser of the continuous loop type, comprising a housing having associated therewith a loop of towel that extends along an exit path from a clean towel supply within the housing to an exposed position accessible to a user and thence along a return path into the housing, towel dispensing mechanism mounted in said housing for dispensing clean towel therefrom into the loop along the exit path when the accessible portion of the loop is pulled by the user, loop take-up mechanism mounted in said housing coupled to said towel dispensing mechanism for retracting and storing soiled towel from the return path, and movable and adjustable tension control mechanism for adjusting the tension in the soiled towel retracted and stored by said loop take-up mechanism to vary the amount of soiled towel taken up during operation of said loop take-up mechanism to control the amount of towel in the loop.

2. The towel dispenser of claim 1, and further comprising means for indicating the degree of slippage between said take-up roll and said drive mechanism therefor.

3. The towel dispenser of claim 1, wherein said tension control mechanism is mounted on said housing.

4. The towel dispenser of claim 1, wherein said tension control mechanism controls the energy required to operate said loop take-up mechanism.

5. The towel dispenser of claim 4, wherein said loop take-up mechanism includes a take-up roll for storage of soiled towel and drive roll therefor, said tension control mechanism controlling the torque required of said drive roll to operate said take-up roll.

6. A towel dispenser of the continuous loop type, comprising a housing having associated therewith a loop of towel that extends along an exit path from a clean towel supply within the housing to an exposed position accessible to a user and thence along a return path into the housing, towel dispensing mechanism mounted in said housing for dispensing clean towel therefrom into the loop along the exit path when the accessible portion of the loop is pulled by the user, loop take-up mechanism mounted in said housing coupled to said towel dispensing mechanism for retracting and storing soiled towel from the return path, means defining a sinuous return path for the soiled towel including a plurality of edge members disposed in engagement with the soiled towel along the return path thereof, and means providing relative movement between at least two of said edge members to adjust the tension in the soiled towel retracted and stored by said loop take-up mechanism to vary the amount of soiled towel taken up during operation of said loop take-up mechanism to control the amount of towel in the loop.

7. The towel dispenser of claim 6, wherein at least two of said edge members are mounted on said housing.

8. The towel dispenser of claim 7, wherein said edge members mounted on said housing are vertically spaced apart, at least one of said edge members being movable toward and away from another one of said edge members.

9. The towel dispenser of claim 8, wherein the uppermost edge member is fixedly mounted.

10. The towel dispenser of claim 6, wherein two vertically spaced-apart edge members are mounted on said housing, the uppermost edge member being fixedly mounted to the housing and the bottommost edge member having a plurality of vertical slots therein for vertical movement with respect to the uppermost edge member.

11. The towel dispenser of claim 10, and further including means on said housing for indicating a predetermined tension in the soiled towel retracted and stored by said loop take-up mechanism.

12. A towel dispenser of the continuous loop type, comprising a housing having associated therewith a loop of towel that extends along an exit path from a clean towel supply within the housing to an exposed position accessible to a user and thence along a return path into the housing, towel dispensing mechanism mounted in said housing for dispensing clean towel therefrom into the loop along the exit path when the accessible portion of the loop is pulled by the user, loop take-up mechanism mounted in said housing coupled to said towel dispensing mechanism for retracting and storing soiled towel from the return path, towel breaker mechanism mounted in said housing having first and second edge members disposed in engagement with the soiled towel along the return path thereof, a towel bed mounted in said housing for accommodating a supply of clean towel therein and having a third edge member thereon, said third edge member being disposed in engagement with the soiled towel along the return path thereof and cooperating with said first and second edge members, for smoothing and tensioning the soiled towel, and movable and adjustable means for adjusting the tension in the soiled towel to vary the amount of soiled towel taken up during operation of said loop take-up mechanism to control the amount of towel in the loop.

13. The towel dispenser of claim 12, wherein said first edge member is fixedly mounted to said housing and said second edge member is mounted on said housing and movable in a vertical direction with respect to said first edge member.

14. The towel dispenser of claim 13, wherein said first edge member extends toward the clean towel supply a greater distance than said second edge member.

15. The towel dispenser of claim 12, and further including indicator means on said housing to indicate the tension in said soiled towel.

16. A towel dispenser of the continuous loop type, comprising a housing having associated therewith a loop of towel that extends along an exit path from a clean towel supply within the housing to an exposed position accessible to a user and thence along a return path into the housing, said housing including a rear wall adapted to be mounted on a support surface and a cover having a front with the bottom edge thereof above the bottom edge of said rear wall and two sides removably mounted on said rear wall, two spaced apart and vertically extending support members mounted on said rear wall, each support member having a cantilever portion with mounting mechanism, a towel bed mounted to said mounting mechanism on the cantilever portions of said support members movable between a dispensing configuration wherein said towel bed is in the closed position thereof and a loading configuration wherein said towel bed extends outwardly from said housing to facilitate the loading of clean towel thereinto, and two end pieces each removably mounted on a respective one of said support members to cover the ends of said towel bed.

17. The towel dispenser of claim 16, wherein said cantilever portion of each wall support member is below the front bottom edge.

18. The towel dispenser of claim 16, wherein said mounting mechanism on each cantilever portion of said support member includes an aperture in said cantilever portion and a bushing in said aperture.

19. The towel dispenser of claim 16, wherein said towel bed is pivotally mounted at the free ends of said cantilever portions of said support members.

20. The towel dispenser of claim 19, wherein said end pieces are also mounted to said towel bed.

21. A towel dispenser of the continuous loop type, comprising a housing having associated therewith a loop of towel that extends along an exit path from a clean towel supply within the housing to an exposed position accessible to a user and thence along a return path into the housing, said housing including a rear wall adapted to be mounted on a support surface and a cover having a front with the bottom edge thereof above the bottom edge of said rear wall and two sides removably mounted on said rear wall, two spaced apart and vertically extending support members mounted on said rear wall, each support member having a cantilever portion with mounting mechanism, a towel bed mounted to said mounting mechanism on the cantilever portions of said support members movable between a dispensing configuration wherein said towel bed is in the closed position thereof and a loading configuration wherein said towel bed extends outwardly from said housing to facilitate the loading of clean towel thereinto, two end pieces each removably mounted on a respective one of said support members to cover the ends of said towel bed, towel dispensing mechanism mounted in said housing for dispensing clean towel therefrom into the loop along the exit path when the accessible portion of the loop is pulled by the user, loop take-up mechanism mounted in said housing coupled to said towel dispensing mechanism for retracting and storing soiled towel from the return path, said loop take-up mechanism including a take-up roll for storing soiled towel and drive mechanism coupled to said dispensing mechanism for driving said take-up roll, and movable and adjustable mechanism for controlling slippage between said take-up roll and said drive mechanism therefor, reducing slippage between said take-up roll and said drive mechanism therefor causing a greater quantity of soiled towel to be stored per revolution of said take-up roll, increasing slippage between said take-up roll and said drive mechanism therefor causing a lesser quantity of soiled towel to be stored per revolution of said take-up roll, thereby to control the amount of towel in the loop.

22. A towel dispenser of the continuous loop type, comprising a housing having associated therewith a loop of towel that extends along an exit path from a clean towel supply within the housing to an exposed position accessible to a user and thence along a return path into the housing, said housing including a rear wall adapted to be mounted on a support surface and a cover having a front with the bottom edge thereof above the bottom edge of said rear wall and two sides removably mounted on said rear wall, two spaced apart and vertically extending support members mounted on said rear wall, each support member having a cantilever portion with mounting mechanism, a towel bed mounted to said mounting mechanism on the cantilever portions of said support members movable between a dispensing configuration wherein said towel bed is in the closed position thereof and a loading configuration wherein said towel bed extends outwardly from said housing to facilitate the loading of clean towel thereinto, two end pieces each removably mounted on a respective one of said support members to cover the ends of said towel bed, towel dispensing mechanism mounted in said housing for dispensing clean towel therefrom into the loop along the exit path when the accessible portion of the loop is pulled by the user, loop take-up mechanism mounted in said housing coupled to said towel dispensing mechanism for retracting and storing soiled towel from the return path, and movable and adjustable tension control mechanism for adjusting the tension in the soiled towel retracted and stored by said loop take-up mechanism to vary the amount of soiled towel taken up during operation of said loop take-up mechanism to control the amount of towel in the loop.

23. A towel dispenser of the continuous loop type, comprising a housing having associated therewith a loop of towel that extends along an exit path from a clean towel supply within the housing to an exposed position accessible to a user and thence along a return path into the housing, said housing including a rear wall adapted to be mounted on a support surface and a cover having a front with the bottom edge thereof above the bottom edge of said rear wall and two sides removably mounted on said rear wall, two spaced apart and vertically extending support members mounted on said rear wall, each support member having a cantilever portion with mounting mechanism, a towel bed mounted to said mounting mechanism on the cantilever portions of said support members moveable between a dispensing configuration wherein said towel bed is in the closed position thereof and a loading configuration wherein said towel bed extends outwardly from said housing to facilitate the loading of clean towel thereinto, two end pieces each removably mounted on a respective one of said support members to cover the ends of said towel bed, towel dispensing mechanism mounted in said housing for dispensing clean towel therefrom into the loop along the exit path when the accessible portion of the loop is pulled by the user, loop take-up mechanism mounted in said housing coupled to said towel dispensing mechanism for retracting and storing soiled towel from the return path, means defining a sinuous return path for the soiled towel including a plurality of edge members disposed in engagement with the soiled towel along the return path thereof, and means providing relative movement between at least two of said edge members to adjust the tension in the soiled towel retracted and stored by said loop take-up mechanism to vary the amount of soiled towel taken up during operation of said loop take-up mechanism to control the amount of towel in the loop.

24. A towel dispenser of the continuous loop type, comprising a housing having associated therewith a loop of towel that extends along an exit path from a clean towel supply within the housing to an exposed position accessible to a user and thence along a return path into the housing, said housing including a rear wall adapted to be mounted on support surface and a cover having a front with the bottom edge thereof above the bottom edge of said rear wall and two sides removably mounted on said rear wall, two spaced apart and vertically extending support members mounted on said rear wall, each support member having a cantilever portion with mounting mechanism, a towel bed mounted to said mounting mechanism on the cantilever portions of said support members movable between a dispensing configuration wherein said towel bed is in the closed position thereof and a loading configuration wherein said towel bed extends outwardly from said housing to facilitate the loading of clean towel thereinto, two end pieces each removably mounted on a respective one of said support members to cover the ends of said towel bed, towel dispensing mechanism mounted in said housing for dispensing clean towel therefrom into the loop along the exit path when the accessible portion of the loop is pulled by the user, loop take-up mechanism mounted in said housing coupled to said towel dispensing mechanism for retracting and storing soiled towel from the return path, towel breaker mechanism mounted in said housing having first and second edge members disposed in engagement with the soiled towel along the return path thereof, a towel bed mounted in said housing for accommodating a supply of clean towel therein and having a third edge member thereon, said third edge member being disposed in engagement with the soiled towel along the return path thereof and cooperating with said first and second edge members for smoothing and tensioning the soiled towel, and means for adjusting the tension in the soiled towel to vary the amount of soiled towel taken up during operation of said loop take-up mechanism to control the amount of towel in the loop.

* * * * *